US010605164B2

(12) United States Patent
Loomis

(10) Patent No.: US 10,605,164 B2
(45) Date of Patent: Mar. 31, 2020

(54) ENGINE ASSEMBLY INCLUDING CAM FOR Z-TYPE ENGINES

(71) Applicant: Robert Verne Loomis, Tucson, AZ (US)

(72) Inventor: Robert Verne Loomis, Tucson, AZ (US)

( * ) Notice: Subject to any disclaimer, the term of this patent is extended or adjusted under 35 U.S.C. 154(b) by 63 days.

(21) Appl. No.: 15/987,322

(22) Filed: May 23, 2018

(65) Prior Publication Data

US 2019/0003380 A1 Jan. 3, 2019

Related U.S. Application Data

(60) Provisional application No. 62/604,254, filed on Jun. 29, 2017.

(51) Int. Cl.

| | |
|---|---|
| ***F02B 75/24*** | (2006.01) |
| ***F01L 1/02*** | (2006.01) |
| ***F02B 75/06*** | (2006.01) |
| ***F01L 1/047*** | (2006.01) |
| ***F01B 1/10*** | (2006.01) |
| ***F02B 75/26*** | (2006.01) |
| *F02B 75/18* | (2006.01) |

(52) U.S. Cl.

CPC ..... *F02B 75/24* (2013.01); *F01B 1/10* (2013.01); *F01L 1/026* (2013.01); *F01L 1/047* (2013.01); *F02B 75/065* (2013.01); *F02B 75/265* (2013.01); *F01L 2001/0476* (2013.01); *F02B 2075/1808* (2013.01)

(58) Field of Classification Search

CPC ..... F02B 75/24; F02B 75/065; F02B 75/265; F02B 75/002; F01B 1/10; F01B 7/14; F01L 1/026; F01L 1/047

See application file for complete search history.

(56) References Cited

U.S. PATENT DOCUMENTS

| | | | | |
|---|---|---|---|---|
| 1,095,074 A | | 4/1914 | Blayney | |
| 1,436,434 A | * | 11/1922 | Conners | F02B 75/243 123/53.3 |
| 4,408,578 A | * | 10/1983 | Konther | F01B 9/04 123/197.1 |
| 5,431,130 A | * | 7/1995 | Brackett | F01B 9/023 123/190.2 |
| 6,085,707 A | | 7/2000 | Nemoto et al. | |
| 8,245,673 B2 | * | 8/2012 | Howell-Smith | F01B 1/0624 123/197.1 |
| 2004/0025823 A1 | | 2/2004 | Snyder et al. | |

* cited by examiner

*Primary Examiner* — Syed O Hasan

(57) ABSTRACT

A compact and efficient Z-twin internal combustion engine is described herein. The Z-twin internal combustion engine comprises horizontally opposed cylinder arrangement that allows for vibration cancellation. The Z-twin engine comprises a central shared cam that drives angled side valves of both the opposing cylinders, thereby greatly reducing moving parts and thus provides a significantly more efficient angled valve approach.

20 Claims, 9 Drawing Sheets

FIG. 9A
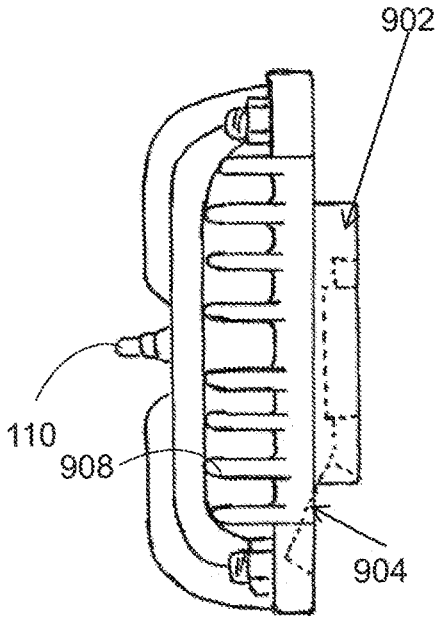
FIG. 9C
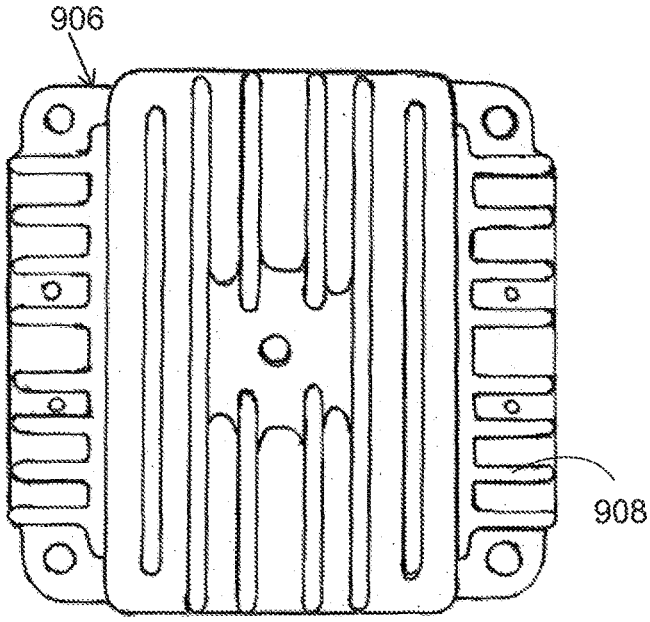
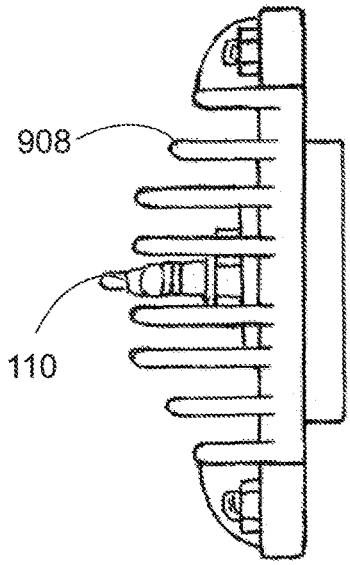
FIG. 9B
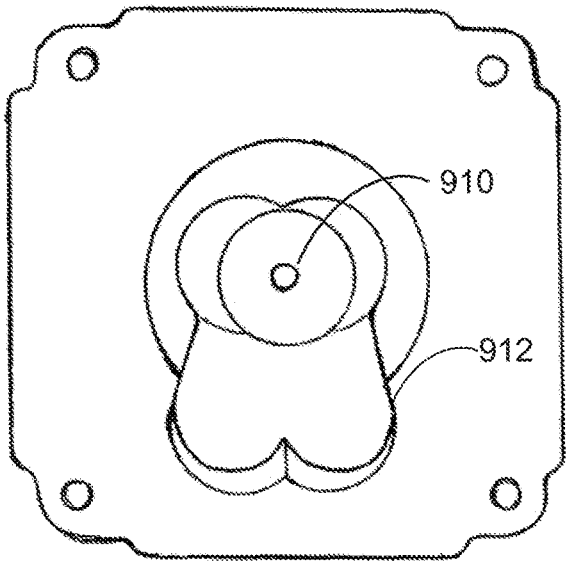
FIG. 9D

ENGINE ASSEMBLY INCLUDING CAM FOR Z-TYPE ENGINES

CROSS REFERENCE

This application claims priority to U.S. Provisional Patent Application No. 62/604,254, filed Jun. 29, 2017, the specification(s) of which is/are incorporated herein in their entirety by reference.

FIELD OF THE INVENTION

The present invention relates to engine assembly for internal combustion engines, more particularly to cam design allowing for a Z-type engine having 180° opposed, vertically offset cylinders having side valve arrangement.

BACKGROUND OF THE INVENTION

Primary design for internal combustion engines, more particularly to motorcycle engines, has been "V-twin" engines, where two cylinders of the engine are arranged in a V-type configuration, enclosing an angle (e.g., 78°) between them. Although widely used, the V-twin engines inherently suffer from vibration issues. As such, imbalances in the V-twin engine caused by reciprocating parts moving up and down or back and forth inside the engine, causes vibrational issues in such engines. In addition, imbalances in the reciprocating parts (meaning they go back and forth or up and down inside the engine) and pulses descending from the combustion event itself—the ignition of fuel and air in the cylinder head. In other words, there is a kind of shake or vibration that is part of that engine's very design, present regardless of the power produced, and yet another that is the result of laying down the torque—much of this is the throb you feel as the bike launches away from the stoplight. To reduce vibration in such engines, typically counter balances and/or rubber frame mounts are added to the engine. As such, adding these counter balances and frame mounts makes the engine heavier, complicated, and more cumbersome.

Another type of engine that is commonly used is the "boxer" engine which includes 180° or horizontally opposed engines. Typically, the boxer engine has cylinders arranged in two banks on either side of a single crankshaft, and as such, the opposing cylinders are effective in cancelling out vibrations arising in the two cylinders. Due to the balanced layout of the opposing cylinders, the boxer engine may not need a balance shaft or counterweights on the crankshaft to balance the weight of the reciprocating parts, however, in the case of boxer engines with fewer than six cylinders, unbalanced moments (a reciprocating torque also known as a "rocking couple") are unavoidable due to the "opposite" cylinders being slightly out of line with each other. In addition, the boxer engine suffers from clearance issues, because of which the engines are put high above the ground. In addition, because of the square shape of the boxer engines, the cylinder heads tend to stick out, specifically in motorcycle frames. As a result, while taking a tight turn, the cylinder head may hit the ground. In view of these aforementioned issues with engine designs, there is a need for a compact, simple, and more efficient engine system with reduced noise and vibrations.

SUMMARY OF THE INVENTION

The present invention provides for a Z-twin internal combustion engine having horizontally opposed cylinder arrangement, having dual counterbalancing cranks that are linked by a common jackshaft. The jackshaft turns a camshaft of the engine providing a primary drive gear as well as providing forced air/fuel injection and assisted exhaust evacuation.

One of the unique and inventive technical features of the present invention is that the cylinders are horizontally opposed parallel cylinders having an offset in a vertical direction, having a cam that drives the angled side valves of the engine assembly. Without wishing to limit the invention to any theory or mechanism, it is believed that the technical feature of the present invention advantageously allows the vibrations occurring in the cylinders to cancel out, and additionally provides for a more compact, simple, and efficient engine. None of the presently known prior references or work has the unique inventive technical feature of the present invention.

The present invention discloses the use of a central shared cam that drives angled side valves of both the opposing cylinders, thereby greatly reducing moving parts and thus provides a significantly more efficient angled valve approach. In some embodiments, the present invention discloses a "clover-head" design of the cylinder head that advantageously increases air/fuel turbulence, squish area, combustion force direction, and overall improved combustion characteristics. In addition, the engine includes a primary drive gear and two secondary gears coupled diagonally on the primary drive gear. As such, the arrangement of the primary drive gear and the secondary gears provides for a narrow alignment in the engine of the present invention, making it ideal for motorcycle and many other possible applications. The present invention discloses a single forced-air exhaust port that greatly reduces heat, space, and weight of the engine. The engine of the present invention includes a central camshaft that also functions as intake/exhaust manifold. As such, the rotation of the central camshaft may drive an impeller coupled to an intake side to provide a supercharged engine overcoming any inefficiencies due to side valve configuration and may additionally drive a turbine expeller coupled to an exhaust side of the engine, thereby providing a turbine assisted exhaust evacuation. Herein, the assisted exhaust evacuation increases efficiency and decreases overall engine temperatures. In summary, the Z-twin engine of the present invention discloses a novel configuration of the cylinders and the side valves, that creates a simpler, lighter, and more efficient internal combustion engine.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

The features and advantages of the present invention will become apparent from a consideration of the following detailed description presented in connection with the accompanying drawings in which:

FIGS. 9A-9B show side views of a cylinder head of the Z-twin engine.

FIGS. 9C-9D show a top down view and a bottom up view respectively of the cylinder head of the Z-twin engine.

DESCRIPTION OF PREFERRED EMBODIMENTS

Figure 1:
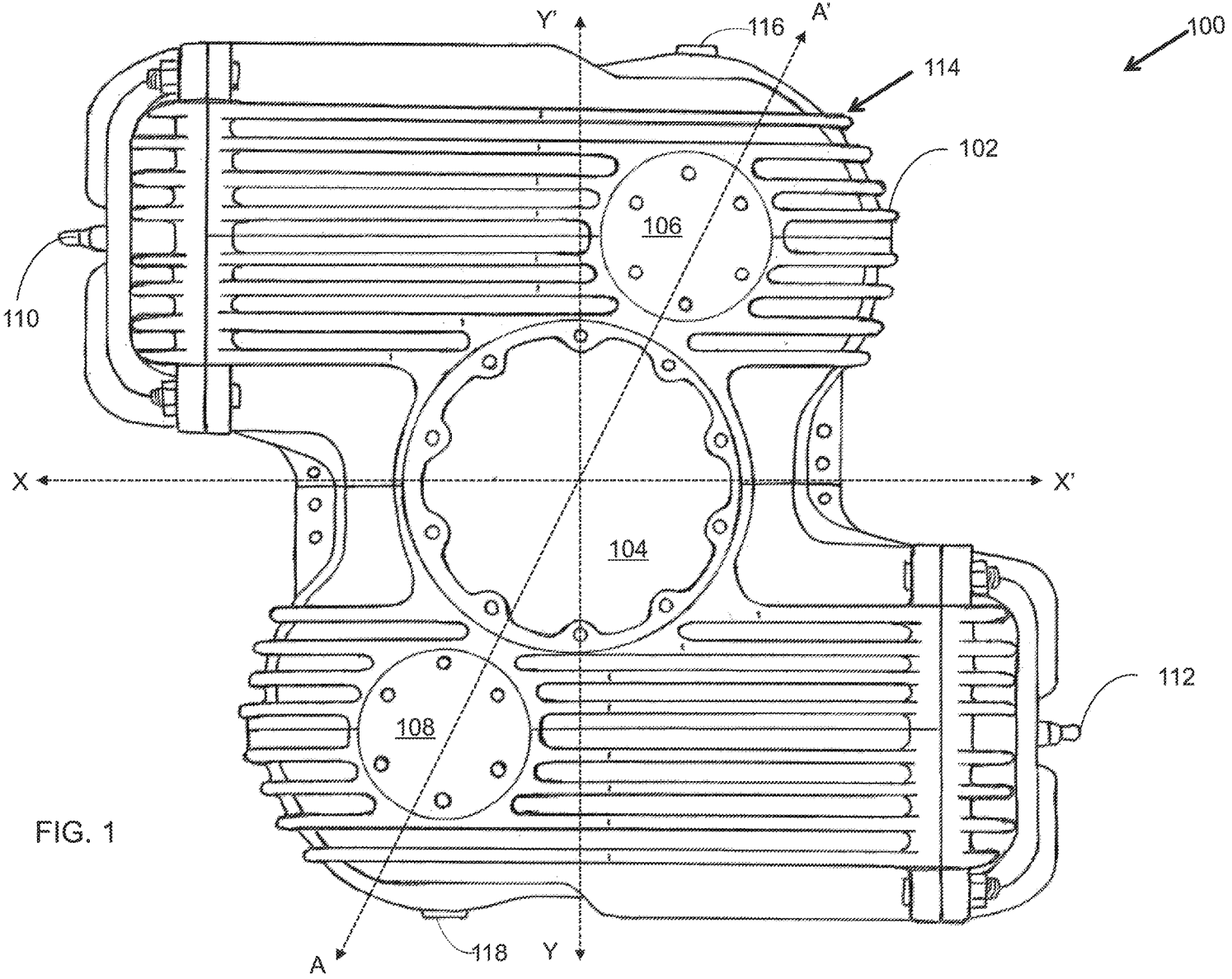
FIG. 1 shows a side view of a Z-twin internal combustion engine having an outer cover, according to an embodiment of the present invention.

Following is a list of elements corresponding to a particular element referred to herein:

100 Z-twin engine
102 outer cover
104 central portion
106 side lobe
108 side lobe
110 spark plug
112 spark plug
114 cooling fins
116 oil in
118 oil out
120 head bolt
202 first crank
204 second crank
206 first secondary gear
208 second secondary gear
210 primary drive gear
212 camshaft
214 first valve stem
216 first valve
218 second valve stem
220 second valve
222 first cylinder
224 second cylinder
226 first piston
228 second piston
230 cam
402 intake side
404 exhaust side
412 flywheel
414 impeller
416 second cam
418 first cam
420 first valve
421 second valve
422 third valve
423 fourth valve
424 finned spacer
426 turbine expeller
428 bearings
502 camshaft
700 series of planetary gears
702 ring gear
704 sun gear
706 planet gears
802 cooling fins
902 cylinder head
904 dashed lines
906 outer cover
908 cooling fins
910 central axis
912 four-leaf clover pattern Referring now to FIG. 1-9D, the present invention features an internal combustion engine (100) have horizontally opposed and vertically offset cylinders that results in a more compact, simple, less vibration, and more efficient engine, compared to the widely used V-twin or boxer engines. Turning to FIG. 1, a side view of a Z-twin internal combustion engine (100) is shown. Herein, the engine (100) includes an outer cover (102) having a plurality of cooling fins (114) to provide adequate cooling for the engine. The plurality of cooling fins (114) predominantly run along a horizontal axis (X-X'). The cooling fins (114) of the outer cover (102) provides air cooling for the underlying engine by providing adequate circulation of air over the hot engine parts. In some embodiments, the engine (100) may use oil for additional cooling and lubrication purposes. As such, the engine (100) may include an oil pump (not show in FIG. 1) which circulates oil through the engine to lubricate the components thereof and additionally carry away accumulated heat due to combustion and friction, for example. Oil may be added to the engine (100) through an oil inlet port (116) and removed from the engine (100) through an outlet port (118).

The outer cover (102) includes a central circular portion (104) and two side lobes (106, 108) that are on diametrically opposite sides of the central circular portion (104), along a diagonal axis (A-A'). As explained below, the central circular portion (104) provides an outer cover for a primary drive gear and the two side lobes (106, 108) provide an outer cover for two secondary gears, as shown below.

Figure 2:
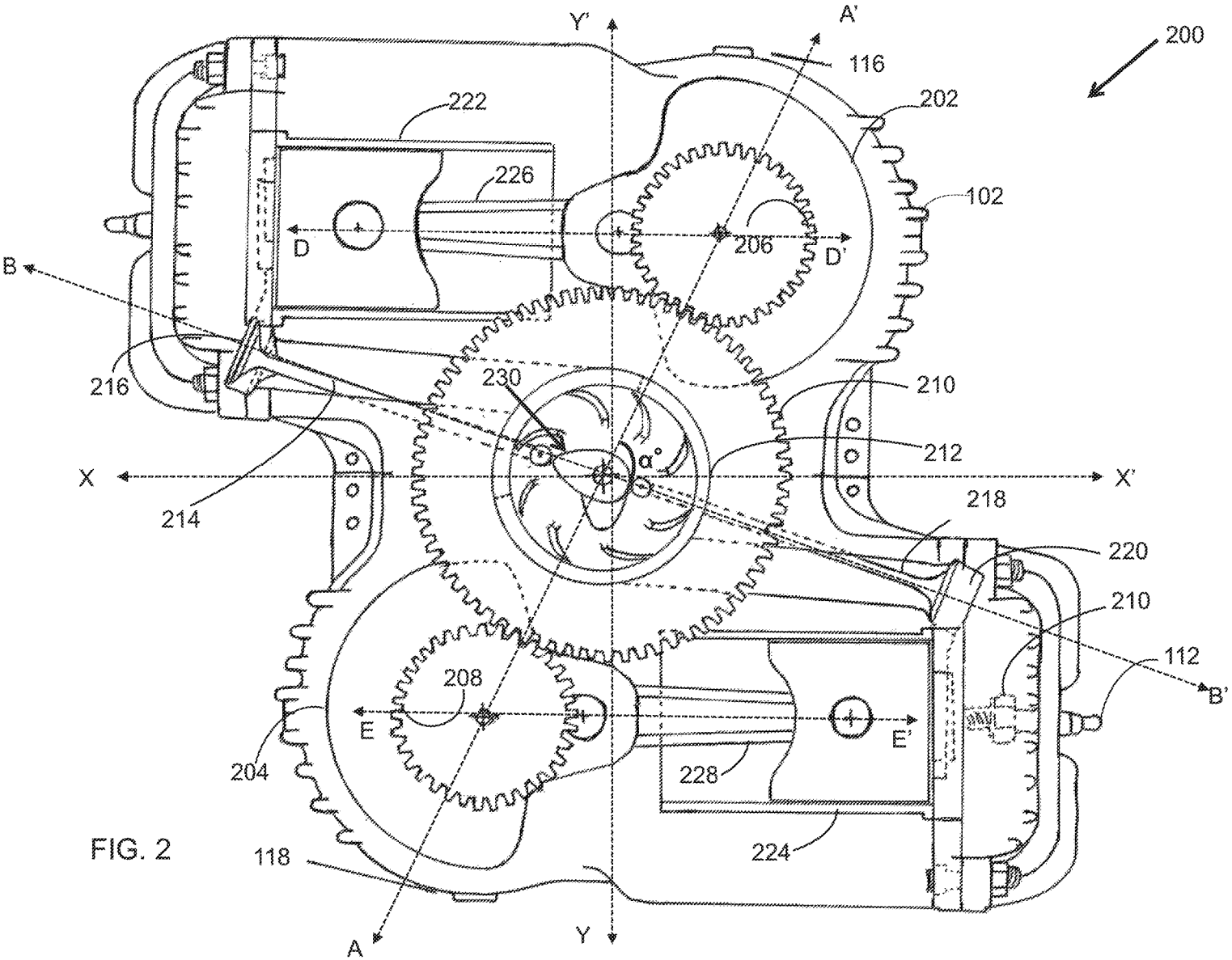
FIG. 2 shows side view of the Z-twin engine including two horizontally opposed cylinders and further including dual counterbalancing cranks linked by a common camshaft, according to an embodiment of the invention.

Turning now to FIG. 2, a side view of the engine (100) without the outer cover (102) is shown. In other words, FIG. 2 shows the inside parts/components of the Z-twin engine. The Z-twin engine (100) includes a first cylinder or chamber (222) and a second cylinder or chamber (224). Herein, the two cylinders are horizontally (e.g., 180°) opposed to one another, and oriented parallel to each other. For example, the first cylinder (222) includes a first piston (226) positioned within walls of the first cylinder (222) configured to move along a first horizontal axis (D-D'). The second cylinder (224) includes a second piston (228) configured to move along a second horizontal axis (E-E'). Herein, the first and the second horizontal axes are parallel to a horizontal axis (X-X") of the engine. Without wishing to limit the invention to a particular mechanism, the 180° opposing orientation of the cylinders of the present invention cancels out the vibrations that occur in the engine due to the movement of the pistons, thereby making the engine more efficient. In addition, the arrangement of the cylinders of the engine of the present invention is more balanced. Thus, without using additional counter balances, the present invention provides for a more balanced engine assembly. The Z-twin engine of the present invention additionally includes a Z-shape design that is formed by vertically offsetting the cylinders, as shown below. Without wishing to limit the invention to a particular mechanism, the vertical offsetting the cylinders makes the entire engine assembly more compact and simple.

The first horizontal axis (D-D') of the first cylinder (222) is vertically offset from the second horizontal axis (E-E') of the second cylinder (224). In one non-limiting example, the first and the second horizontal axes may be separated by about 10" along the vertical axis (Y-Y'). In other examples, the first and the second horizontal axes may be separated by about 8-12" along the vertical axes. As such, these values are example values only, and not meant to be limiting. Other values of the separation may be used without deviating from the scope of the invention.

The engine of the present invention is a flathead or sidevalve engine where the inlet and exhaust valves are positioned on the sides of the cylinders, and contained within the engine block, instead of in the cylinder head, as in an overhead valve engine. Herein, a first valve (216) of the first cylinder (222) and a second valve (220) of the second cylinder (224) are driven by a cam (230) of a camshaft (212). More specifically, the first and the second valves are configured to open/close inlet/outlet ports of the corresponding cylinder. It may be noted that each cylinder includes two valves, but only one valve is visible in the side view. Both the valves are shown in a top view, further below. Herein, the engine (100) includes a primary drive gear (210) coupled to the camshaft (212), and a rotation of the primary drive gear (210) alternately opens and closes the first and the second valves, as explained below.

The first cylinder (222) includes a first piston (226) coupled to a first crank (202). More specifically, a first secondary gear (206) of the first crank (202) is coupled to the first piston (226). The movement of the first piston (due to compression and combustion of air/fuel mixture within the first cylinder (222), for example) causes the piston to move horizontally along the first horizontal axis (D-D'). As such, the horizontal movement of the first piston (222) within the first cylinder (222) may rotate the first secondary gear (206) of the first crank (202). Likewise, the second cylinder (224) includes a second piston (228) coupled to a second crank (204). More specifically, a second secondary gear (208) of the second crank (204) is coupled to the second piston (228). The movement of the second piston (due to compression and combustion of air/fuel mixture within the second cylinder (224), for example) causes the piston to move horizontally along the second horizontal axis (E-E'). As such, the horizontal movement of the second piston (228) within the first cylinder (224) may rotate the second secondary gear (208) of the second crank (204).

The first and the second secondary gears of the engine (100) may be coupled to the primary drive gear (210) along a diagonal axis (A-A'). Herein, the first horizontal axis (D-D'), the diagonal axis (A-A'), the second horizontal axis (E-E') together form a Z-shape of the internal combustion engine resulting in a more compact engine with reduced vibrations and higher efficiency.

Figure 3:
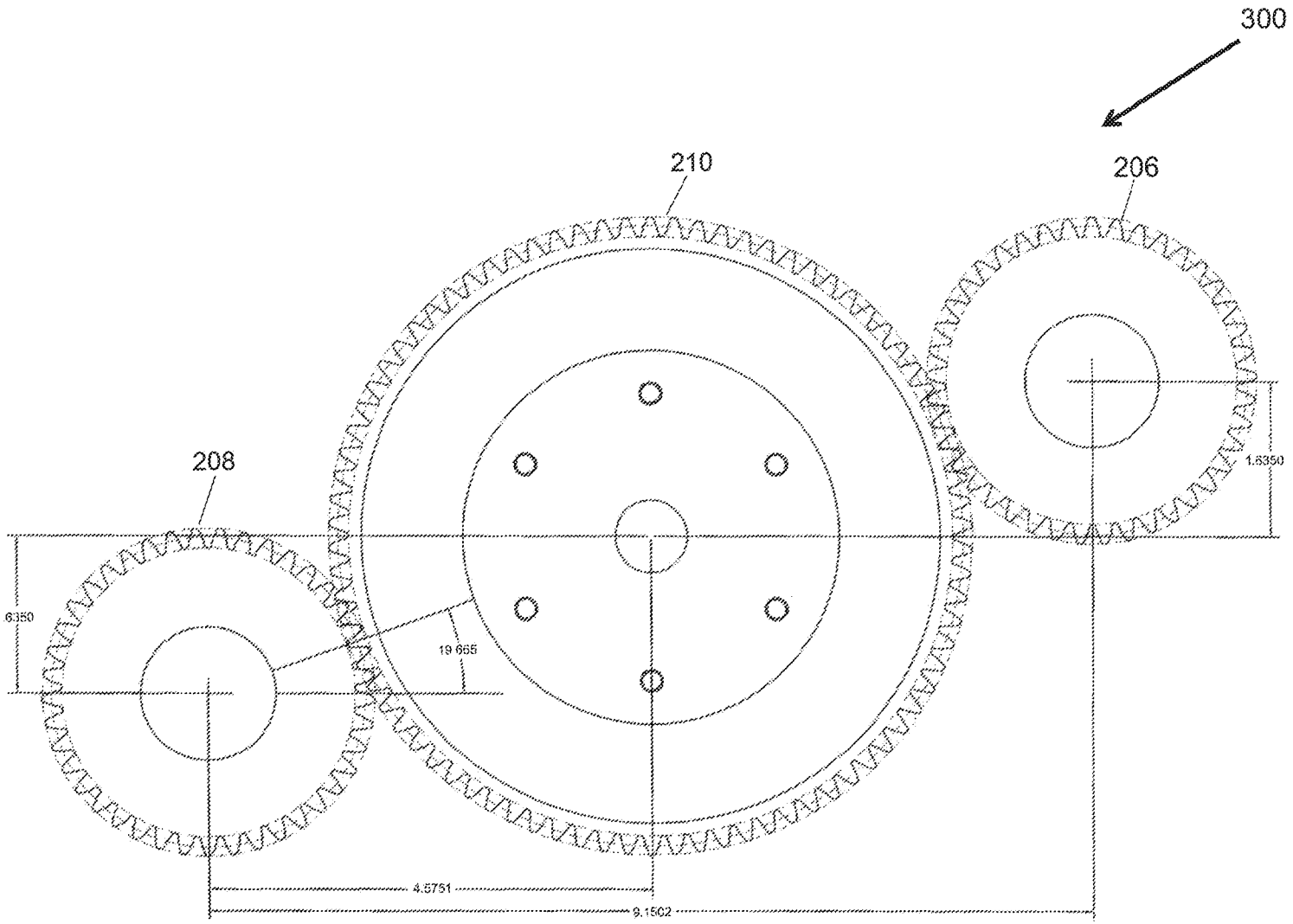
FIG. 3 shows a primary drive gear rotatably coupled to two secondary gears of the cranks, according to an embodiment of the invention.

As shown in FIG. 3, the first secondary gear (206) is coupled to the primary drive gear (210) diametrically opposite to the second secondary gear (208). In one non-limiting example, an angle between the second diagonal axis (A-A') and the second horizontal axis (E-E') may be about 20°. In other examples, the angle between the diagonal axis (A-A') and the second horizontal axis (E-E') may be between about 0°-65°, These values are meant as example values only, and not meant to be limiting. Other values of the angle may be used without deviating from the scope of the invention.

Each of the primary drive gear, the first and the second secondary gears include a circular cross-section having a plurality of interlocking teeth along the circumference. Without limiting the invention to a particular mechanism, the interlocking teeth allow for the rotation of the second gears to be transferred to the primary drive gear. It may be appreciated that the secondary gears rotate in a first (e.g., clockwise) direction, while the primary drive gear rotates in a second direction, which is opposite (e.g., anti-clockwise) direction. As such, the rotation of the primary drive gear (210) is coupled to the camshaft (212), wherein a cam (230) of the camshaft (212) operates the first and the second valves of each of the cylinders, as explained below. Herein, the first and the second valves may also be referred to as angled valves.

The first valve (216) is coupled to the cam (230) via a first valve stem (214). Likewise, the second valve (220) is coupled to the cam (230) via a second valve stem (218). Herein, a rotation of the primary drive gear (210) moves the first and the second valve stems along a diagonal axis (B-B'). Herein the diagonal axis (B-B') may be referred to as a first diagonal axis, and the diagonal axis (A-A') may be referred to as a second diagonal axis. As such, the first and the second diagonal axes intersect at an angle, a. In some non-limiting example, the angle $\alpha$ may include a range of angles, from about 90 to 135°. In one non-limiting example, the first and the second diagonal axes may be orthogonal, implying that angle $\alpha$=90°. As such, the values provides are for example purposes only, and not meant to be limiting. Other values of angle $\alpha$ may be used without deviating from the scope of the invention.

In one non-limiting example, when the primary drive gear (210) rotates along the second direction, the first valve stem (214) pushed outwardly, which in turn pushes the first valve (216) against an opening/port of the first cylinder. By pushing the first valve stem (214), the cam (230) closes the opening or port of the first cylinder. At the same time when the first valve closes the first cylinder, the cam draws the second valve stem (218) inwards, thereby drawing the second valve (220) away from an opening/port of the second cylinder (224). When the second valve (220) is drawn away from the opening or port of the second cylinder (224), the port or opening of the second cylinder (224) is said to be open. In this way, the cam simultaneously opens and closes ports of the two cylinders using the angled valves. As a non-limiting example, the ports of the first and the second cylinders may be inlet ports. Thus, the rotation of the primary drive gear (210) causes the intake port of the first cylinder (222) to be closed while opening the intake port of the second cylinder (224). Additional valves (not shown in FIG. 2) may be coupled to the cam (230) to further open and close other ports, such as exhaust ports of the cylinders, for example. Thus, the cam may control the timing and quantity of air/fuel mixture into the cylinder and additionally control timing and quantity of spent air/fuel mixture out of the cylinder. Additionally, as the valves are diametrically opposed, the force required to open any valve is reduced by the force of the opposite closing valve, further increasing engine efficiency. In some embodiments, the valves (216, 220) may be poppet valves.

In this way, the alignment of the cylinders, the valves, and the gears (primary and secondary) allows for vibration cancelling in the engine of the present invention. In addition, the horizontally opposing and vertical offset placement of the cylinders allows the engine of the present invention to be more compact simple, and more efficient. Herein, the cam (230) may also be referred to as a central shared cam, which greatly reduces moving parts and provides significantly more efficient angled valve approach.

In some embodiments, the present invention may include a flywheel coupled to the camshaft that rotates impellers and/or expellers to supercharge and/or turbine-assisted cooling, as discussed below.

Figure 4:
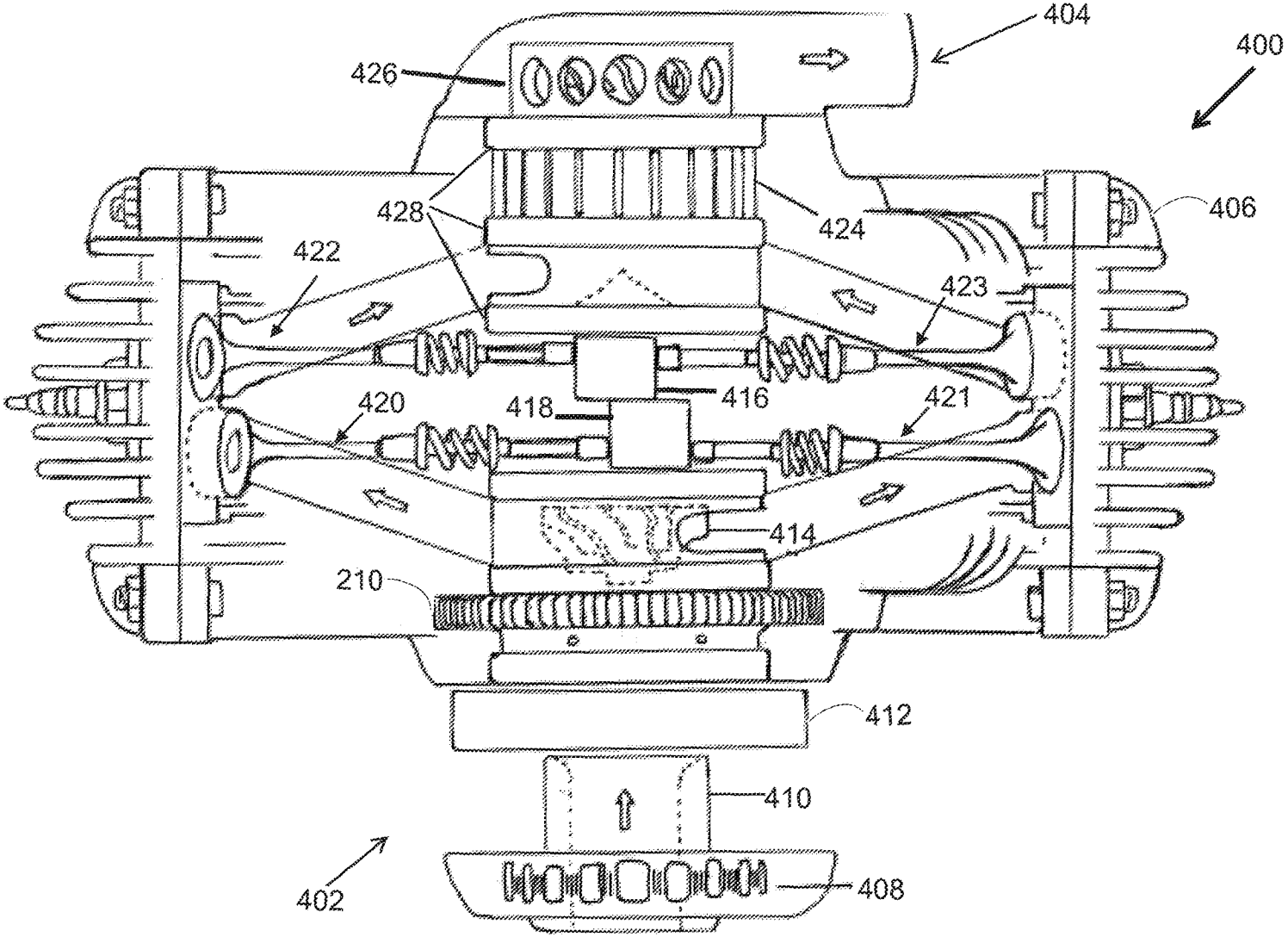
FIG. 4 shows a top view of the Z-twin engine including a flywheel coupled to the primary drive gear, and further including an impeller and an expeller driven by the camshaft/flywheel, according to an embodiment of the present invention.
Figure 5:
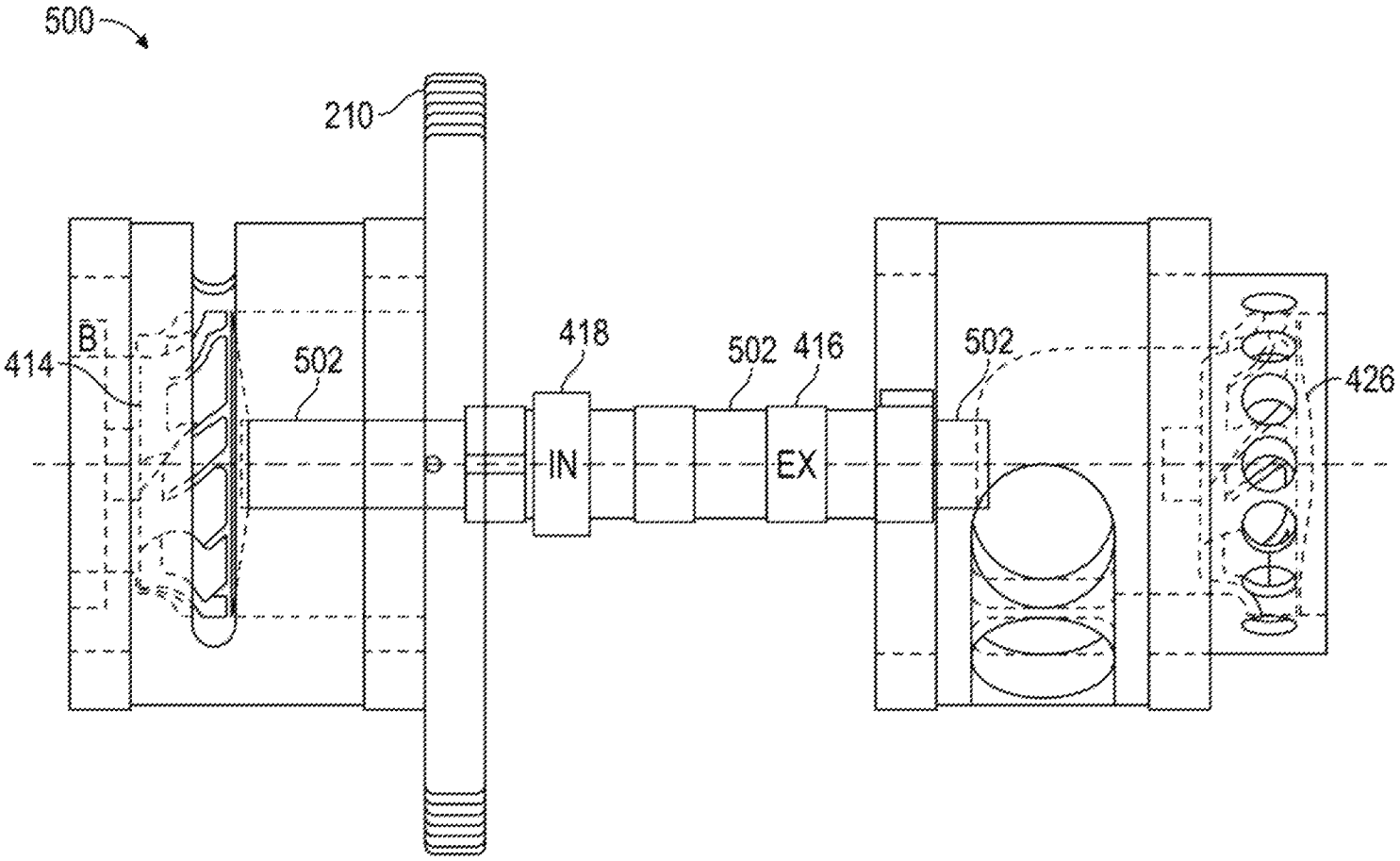
FIG. 5 shows a side view of the Z-twin engine having the impeller and expeller coupled to an intake and an exhaust side of the engine respectively.

Turning now to FIGS. 4 and 5, a top view (400) and a side view (500) of the engine (100) is shown. The engine (100) includes an intake side (402) and an exhaust side (404). The engine (100) includes a central camshaft (502) that can act an intake and/or exhaust manifold. As described previously, cams of the camshaft (502) may be used to operate angled side valves to open/close opposing cylinders (such as cylinders 222 and 224 previously described).

More specifically, a cam (418) of the camshaft (502) may be configured to operate a first set of valves (420, 421). Herein, the first set of valves includes a first valve (420) configured to open/close a port of a first cylinder (not shown in view 400), and additionally includes a second valve (421) configured to close/open a port of a second cylinder (not shown in view 400). In one non-limiting example, the first valve (420) and the second valve (421) may be examples of the first valve (216) and the second valve (220) of FIG. 2. Like the first cam (418), a second cam (416) of the camshaft (502) may be configured to operate a second set of valves (422, 423). As such, the second set of valves includes a third valve (422) configured to close/open a port of the first cylinder (not shown in view 400), and additionally includes a fourth valve (423) configured to open/close a port of the second cylinder (not shown in view 400).

In one non-limiting example, the first set of valves may be intake valves configured to open and close the intake port of the first and second cylinder respectively. In such an example, the second set of valves may be exhaust valves configured to open and close exhaust port of the first and second cylinder respectively. As described previously, the camshaft (502) is coupled to the primary drive gear (210) and the rotation of the gear (210) allows for the operation of the valves.

Figure 6:
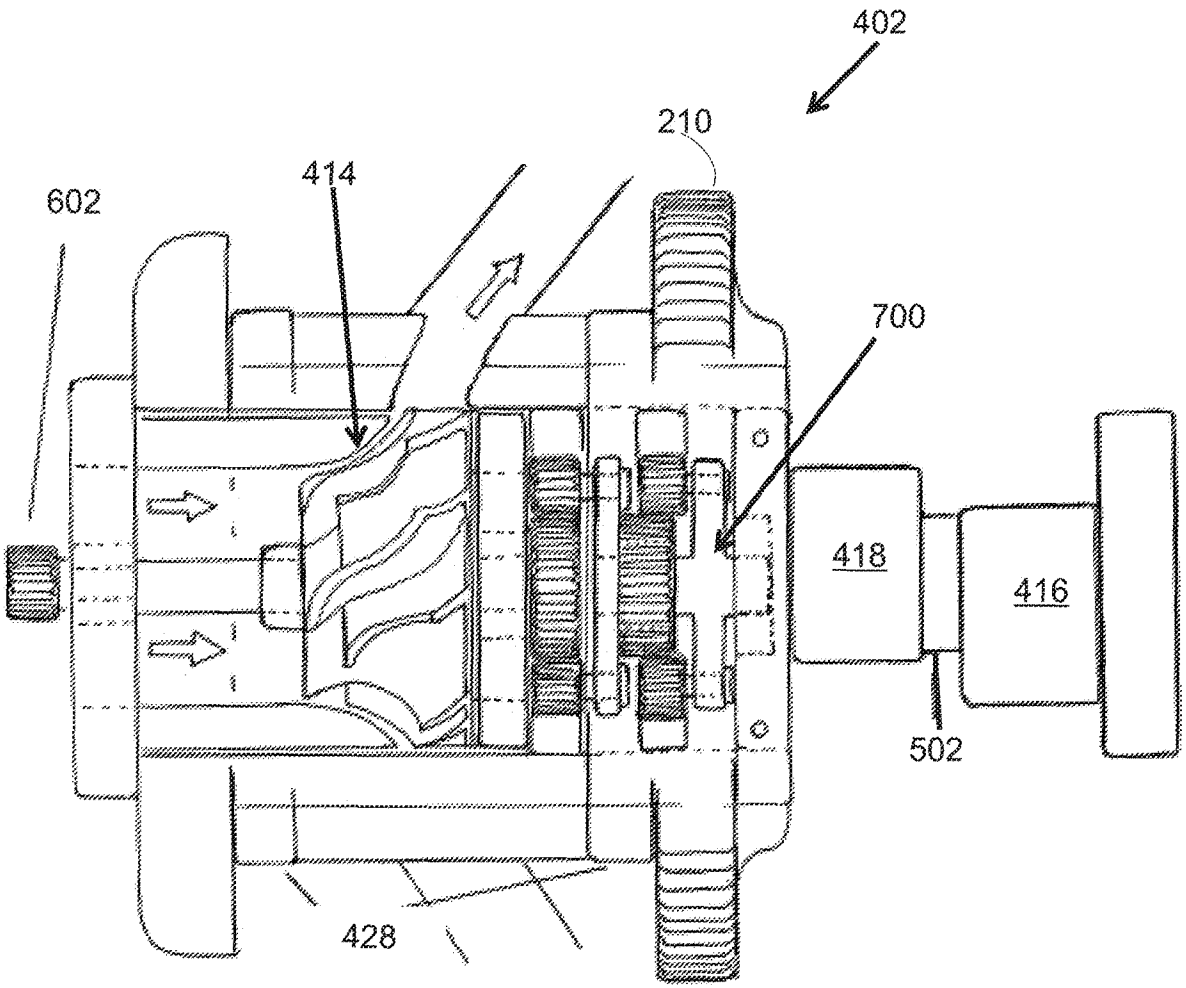
FIG. 6 shows the impeller coupled to the camshaft via a series of planetary gears.

A flywheel (412) may be rotatably coupled to the camshaft (502) on the intake side (402). In some embodiments; an impeller (414) may be optionally coupled to the camshaft (502). In one non-limiting embodiment, the impeller (414) may be coupled to the camshaft (502) directly mounted to the camshaft or via a series of planetary gears or other possible gear configurations to increase turbine rotational speed as required; including a variable speed application allowing for increase/decrease of forced air/fuel volume aka "boost" (700), shown in FIG. 7. FIG. 6 shows an exploded view of the intake side (402) of the engine (100), wherein the planetary gears (700) and the impeller (414) are coupled to the primary drive gear (210).

Figure 7:
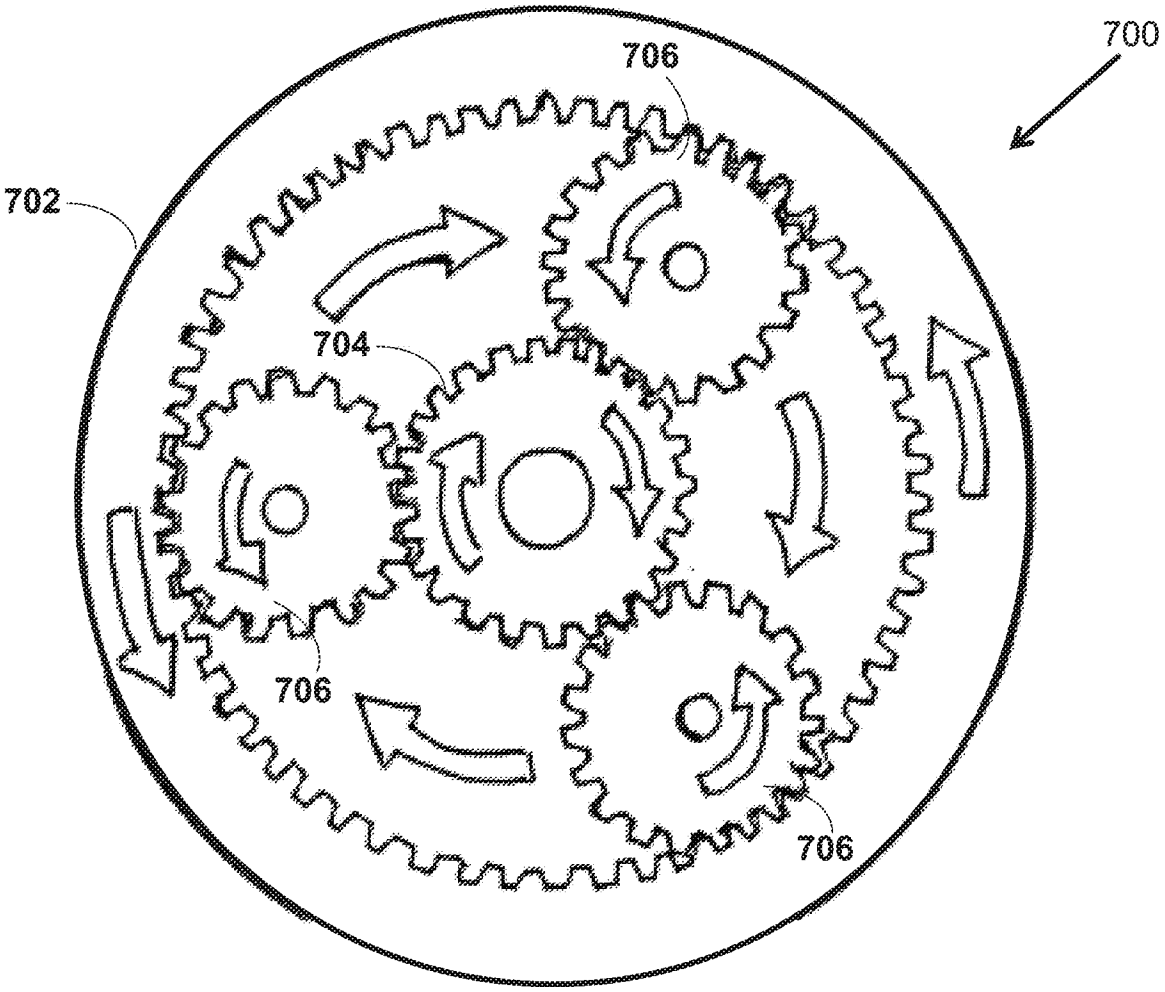
FIG. 7 shows an arrangement of the series of planetary gears.

When combustion occurs within the cylinders, the horizontal motion of the pistons drive the secondary gears, which in turn rotates the primary drive gear. As such, the rotation of the primary drive gear is transferred to the turbine/impeller via the series of planetary gears (700). Herein, the series of planetary gears (700) may include a sun gear (704), a plurality of planet gears (706), and ring gear (702). Sun gear (704) is located at the center that transmits torque to planet gears (706) orbiting around the sun gear. Both systems are located inside the ring gear. In the toothed formation sun and planet gears are externally mesh and ring gear internally meshes, as shown in FIG. 7.

The series of planetary gears (700) spin the impeller (414) to a required rpm for modest boost. As such, spinning of the impeller (414) force feeds additional air/fuel mixture into the cylinder; thereby supercharging the engine (100). It may be appreciated that the stored rotational kinetic energy associated with the spinning of the flywheel is used to supercharge the engine, thereby using little to no additional energy from the engine; contrary to how typical supercharged engines work. The low boost is intended to overcome air/fuel flow restrictions from a side-valve configuration of the present invention without generating excessive heat or requiring the usual energy of typical supercharger driver system.

Figure 8:
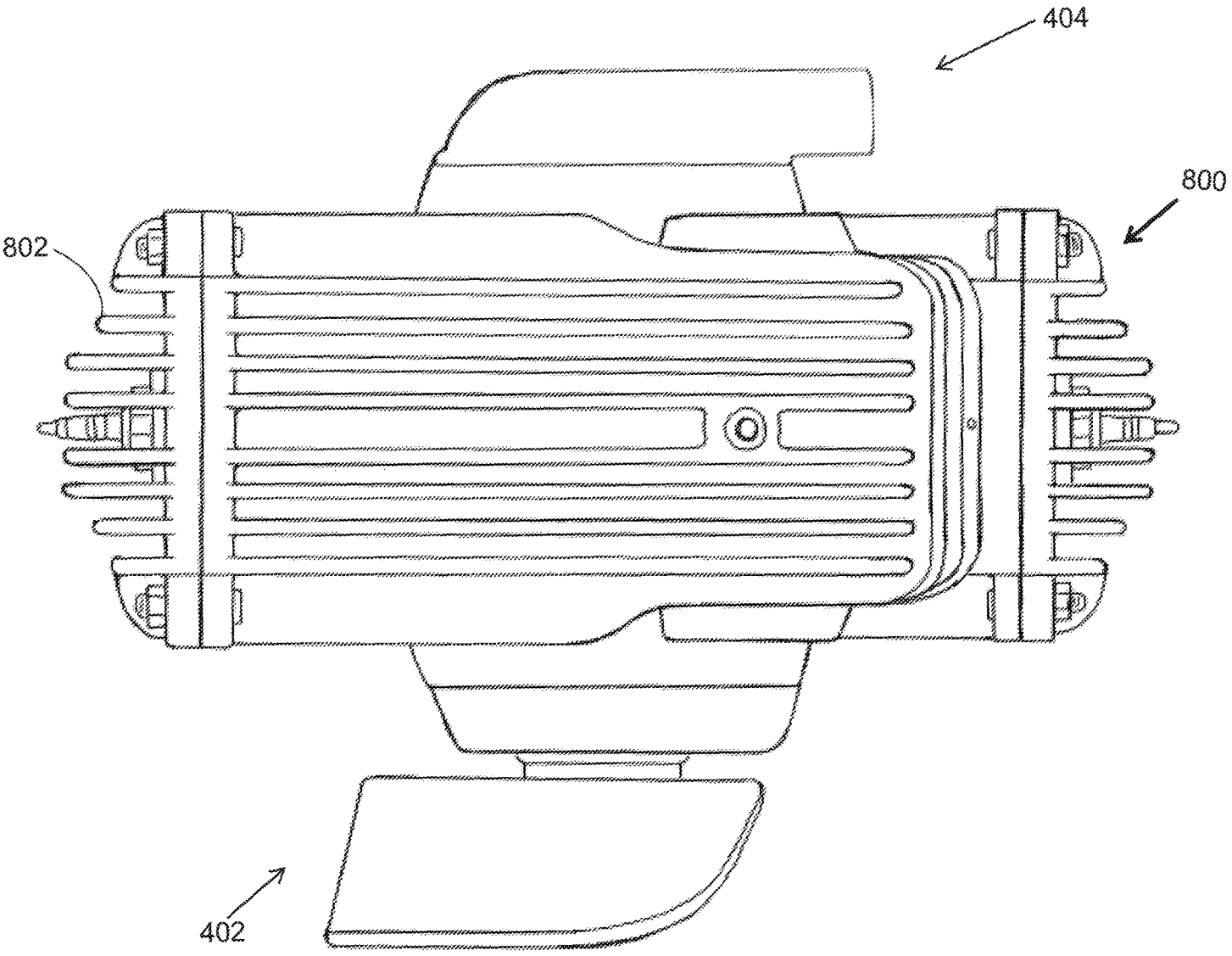
FIG. 8 shows a top cover of the Z-twin engine having cooling fins.

In some embodiments, an expeller or turbine expeller (426) may be coupled to the exhaust side (404) of the engine (100). More specifically, the expeller (426) is coupled directly to the camshaft (502) or alternatively, geared similar to the intake configuration via planetary or other gear systems described previously (428). The stored rotational energy of the flywheel is used via the turbine impeller to create a vacuum effect, reducing the work required by the cylinders to expel exhaust and also reducing the heat generated as the exhaust gasses are allowed to expand sooner than typical engine designs. A finned spacer (424) may be included between the bearings to assist cooling (428). Rotation of the flywheel rotates the expeller, and as such, the rotation allows for 180° port distribution similar to the effect of typical disc valve designs normally found in two-stroke motor applications, thereby increasing valve spring/seat tolerances, and further eliminating potential exhaust contamination associated with resonance. In typical engine design, exhaust gasses can bounce back from the inner surfaces of the exhaust ports (resonance) and re-enter the combustion chamber while the exhaust valves are open. This tendency is minimized by the added directional force created by the expeller and rotating exhaust ports. When the expeller rotates and the exhaust valve is opened, exhaust is drawn away from the combustion chamber, into the expeller, which then directs the exhaust into a larger port and out of the engine. In this way, the engine is cooled using the expeller and hence the engine runs cooler. In addition to the cooling provided by the expeller, an outer cover (800) having cooling fins (802) may be used to cover the sides of the engine, as shown in FIG. 8. Further still, the expeller can more efficiently withdraw exhaust from the engine, thereby eliminating exhaust contamination.

While the engine described thus far refers to two cylinder engines, the Z-type arrangement of the cylinders may be extrapolated to four, six, eight cylinders and so on, without deviating from the scope of the invention.

Turning now to FIGS. 9A-9D, a cylinder head (902) design is shown. FIGS. 9A and 9B shows a side view of an outside and an inside of the cylinder head, while FIG. 9C shows a top down view of the cylinder head, and FIG. 90 shows an inside-out view of the cylinder head. Herein, the cylinder head (902) may be non-limiting example of the cylinder head used in conjunction with the cylinders used in the engine of the present invention. A spark plug (110) provides the spark necessary for combustion of the air/fuel mixture inside the cylinder. An outer cover (906) having a plurality of cooling fins (908) may be used to provide cooling for the cylinder head (902). As explained previously, the cylinder includes inlet and outlet ports. The dashed lines (904) refer to a port of the cylinder. The port may be an intake or exhaust port. Each port of the cylinder includes a four-leaf clover pattern (912) about a central axis (910) of the cylinder. Without wishing to limit the invention to a particular mechanism, the clover pattern on the cylinder head increases air/fuel turbulence, squish area, combustion force direction, and overall improved combustion characteristics.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A Z-type side valve internal combustion engine comprising: a primary drive gear coupled to a camshaft, wherein a first cam of the camshaft is coupled to a first valve of a first cylinder and a second valve of a second cylinder, and wherein a second cam of the camshaft is coupled to a third valve of the first cylinder and a fourth valve of the second cylinder, and wherein a rotation of the primary drive gear alternately opens and closes the first valve and the second valve and opens and closes the third valve and the fourth valve, and wherein the first valve and the second valve are coupled diagonally to the camshaft along a first diagonal axis, and wherein the third valve and the fourth valve are coupled diagonally to the camshaft along the first diagonal axis; a first secondary gear rotatably coupled to the primary drive gear, and further coupled to a first piston of the first cylinder, the first secondary gear is configured to rotate from horizontal movement of the first piston within the first cylinder along a first horizontal axis; and a second secondary gear rotatably coupled to the primary drive gear, the first secondary gear and the second secondary gear are coupled to diametrically opposite ends of the primary drive gear along a second diagonal axis, wherein the second diagonal axis and the first diagonal axis intersect at an angle, wherein the second secondary gear is further coupled to a second piston of the second cylinder, wherein the second secondary gear is configured to rotate from horizontal movement of the second piston within the second cylinder along a second horizontal axis, and wherein the second cylinder is parallel to, horizontally opposed to, and vertically offset from the first cylinder, wherein the first horizontal axis, the second diagonal axis, and the second horizontal axis together form a Z-shape of the internal combustion engine resulting in a more compact engine with reduced vibrations and higher efficiency.

2. The engine of claim 1, further comprising a flywheel rotatably coupled to the primary drive gear on the camshaft.

3. The engine of claim 2, further comprising an expeller coupled to the camshaft on an exhaust side of the engine, wherein spinning of the flywheel spins the expeller and provides a turbine assisted exhaust evacuation for the engine, thereby decreasing an overall temperature of the engine.

4. The engine of claim 2, further comprising an impeller coupled to the camshaft and flywheel on an intake side of the engine through a series of planetary gears, wherein the primary drive gear is configured to rotate the flywheel in an opposite direction providing vibration cancelling counter rotational force and wherein spinning of the flywheel and camshaft spins the impeller and force feeds additional air/fuel mixture into the engine thereby supercharging the engine.

5. The engine of claim 1, wherein the first secondary gear and the second secondary gear rotate in the same direction while the primary drive gear and flywheel rotate in an opposite direction.

6. The engine of claim 1, wherein each of the first cylinder and the second cylinder comprises a clover-shaped cylinder head configured to increase an air/fuel turbulence, and combustion force direction, and enhance combustion characteristics of the engine.

7. The engine of claim 1, wherein the angle at which the second diagonal axis and the first diagonal axis intersect ranges from about 45 to 90 degrees.

8. The engine of claim 1, wherein the first valve and the second valve are intake/exhaust side valves configured to allow intake air to enter/exhaust air to exit out from a side of each cylinder, and wherein the third valve and the fourth valve are exhaust/intake side valves configured to allow exhaust air to exit out/intake air to enter from a side of each cylinder.

9. The engine of claim 1, further comprising air and oil cooling mechanisms integrated with the engine.

10. A Z-twin engine, comprising: two horizontally opposed, vertically offset parallel cylinders; a central camshaft driving a first cam and a second cam, wherein the first cam is configured to operate a first set of side valves of the cylinders along a first diagonal axis, wherein the second cam is configured to operate a second set of side valves of the cylinders along the first diagonal axis, and wherein the central camshaft comprises a primary drive gear of the engine; and two counterbalancing cranks coupled to the cylinders, each crank comprising a secondary gear rotatably coupled to the primary drive gear, and wherein the secondary gears of the cylinders are diametrically opposite to each other, wherein placement of the two cylinders relative to the diametrical orientation of the primary and secondary gear forms a Z-shape, which allows for vibration cancellation in the engine, and wherein the horizontally opposed cylinder position along with the counterbalancing cranks together provide for a compact, simple and efficient engine design.

11. The Z-twin engine of claim 10, further comprising: a flywheel coupled to the primary drive gear of the central camshaft along an intake side of the engine; and an intake impeller coupled to the central camshaft on the intake side through a series of planetary gears, wherein the primary drive gear is configured to rotate the flywheel in an opposite direction and wherein spinning of the flywheel spins the impeller and force feeds additional air/fuel mixture into the engine thereby supercharging the engine.

12. The Z-twin engine of claim 10, further comprising: a flywheel coupled to the primary drive gear of the central camshaft along an intake side of the engine; and an expeller coupled to the central camshaft on an exhaust side of the engine, wherein spinning of the flywheel spins the expeller and provides a turbine assisted exhaust evacuation for the engine, thereby decreasing an overall temperature of the engine and preventing exhaust contamination.

13. The Z-twin engine of claim 10, wherein each cylinder comprises a clover-shaped cylinder head configured to increase an air/fuel turbulence, and combustion force direction, and enhance combustion characteristics of the engine.

14. The Z-twin engine of claim 10, wherein the first cam is configured to alternately open and close the first set of valves, and the second cam is configured to alternately open and close the second set of valves.

15. The Z-twin engine of claim 10, wherein the first set of valves comprises intake side valves of the two cylinders and the second set of valves comprises exhaust side valves of the two cylinders.

16. The Z-twin engine of claim 15, wherein when the first intake side valve of the first cylinder is opened, the first exhaust side valve of the first cylinder is closed, the second intake side valve of second cylinder is closed, and the second exhaust side valve of the second cylinder is opened.

17. The Z-twin engine of claim 15, wherein when the second intake side valve of the second cylinder is opened, the second exhaust side valve of the second cylinder is closed, the first intake side valve of first cylinder is closed, and the first exhaust side valve of the first cylinder is opened.

18. A Z-type internal combustion engine comprising: a primary drive gear coupled to a camshaft, wherein a first cam of the camshaft is coupled to a first valve of a first cylinder and a second valve of a second cylinder diagonally along a first diagonal axis, and wherein a second cam of the camshaft is coupled to a third valve of the first cylinder and a fourth valve of the second cylinder along the first diagonal axis; a first secondary gear rotatably coupled to the primary drive gear, and further coupled to a first piston of the first cylinder, the first secondary gear configured to move with the first piston horizontally within the first cylinder along a first horizontal axis; a second secondary gear rotatably coupled to the primary drive gear, the first secondary gear and the second secondary gear are coupled to diametrically opposite ends of the primary drive gear along a second diagonal axis, wherein the second secondary gear is further coupled to a second piston of the second cylinder, wherein the second secondary gear is configured to move with the second piston horizontally within the second cylinder along a second horizontal axis, and wherein the second cylinder is parallel to, horizontally opposed to, and vertically offset from the first cylinder, wherein the first horizontal axis, the second diagonal axis, the second horizontal axis together form a Z-shape of the internal combustion engine resulting in a more compact engine with reduced vibrations and higher efficiency; a flywheel rotatably coupled to the primary drive gear, wherein the primary drive gear is configured to rotate the flywheel in an opposite direction, wherein a series of planetary gears is rotatably coupled to the flywheel; an impeller coupled to an intake side of the engine through the series of planetary gears, wherein spinning of the flywheel spins the planetary gears, which spins the impeller and provides additional air/fuel mixture into the engine thereby supercharging the engine; and an expeller coupled to an exhaust side of the engine, wherein spinning of the flywheel spins the expeller and provides a turbine assisted exhaust evacuation for the engine, thereby decreasing an overall temperature of the engine and decreasing exhaust contamination.

19. The engine of claim 18, wherein a rotation of the primary drive gear alternately opens and closes the first valve and the second valve.

20. The engine of claim 18, wherein the second diagonal axis and the first diagonal axis intersect at an angle between 45 and 90 degrees.

* * * * *